United States Patent [19]

Gilmore et al.

[11] 4,324,998

[45] Apr. 13, 1982

[54] BASE AND TERMINAL-PIN ASSEMBLY FOR AN ELECTRIC LAMP

[75] Inventors: John F. Gilmore, Verona; Stanley A. Lopenski, Pompton Plains, both of N.J.

[73] Assignee: Westinghouse Electric Corp., Pittsburgh, Pa.

[21] Appl. No.: 136,648

[22] Filed: Apr. 2, 1980

[51] Int. Cl.[3] ..... H01J 5/48; H01J 5/50

[52] U.S. Cl. ..... 313/318; 313/217; 313/331; 339/145 D; 339/54; 339/221 L; 339/273 F

[58] Field of Search ..... 313/318, 331, 217; 339/53, 54, 221 R, 221 L, 267, 269, 271, 273 F, 273 S, 145 R, 145 D; 174/197, 198, 199

[56] References Cited

U.S. PATENT DOCUMENTS

| | | | |
|---|---|---|---|
| 2,771,589 | 11/1956 | Thomas | 339/144 |
| 3,534,216 | 10/1970 | Gilbert, Jr. et al. | 313/331 X |
| 3,805,215 | 4/1974 | Davis, Jr. | 339/221 L |

*Primary Examiner*—Saxfield Chatmon, Jr.
*Attorney, Agent, or Firm*—D. S. Buleza

[57] ABSTRACT

The lead-in wires of a fluorescent lamp are electrically connected to the base pins by mechanical means instead of welding or soldering the members to each other in the conventional manner. This is achieved by forming the pins from solid metal or rigid heat-tempered sheet metal, trimming the lead wires to a predetermined length such that the ends thereof extend beyond the plastic insulator portion of the base when the lead wires are inserted through a pair of apertures provided in the insulator and the base is placed on the sealed end of the lamp envelope, partially inserting the metal pins in the insulator apertures, wrapping the protruding ends of the lead wires around the medial portions of the respective pins, and then force fitting the inner ends of the metal pins into the apertures so that they are firmly anchored in the plastic insulator and the wrapped-around portions of the lead wires are recessed within shallow cavities provided in the outer face of the insulator. The metal pins are thus clamped in positive electrical engagement with the "captured" ends of the lead wires and final assembly of the base is completed during the same sequence of operations required to fasten it to the lamp envelope. The length of the exposed end portions of the metal pins and the spacing therebetween are controlled to provide pin-terminals that conform with the standards established for "bi-pin" type fluorescent lamps and also eliminate the expensive and inefficient soldering or welding operations required to connect the lead wires to the hollow-apertured pins of conventional type bases that are preassembled and thus have such metal pins previously staked or fastened to the insulator component of the base structure.

10 Claims, 4 Drawing Figures

BASE AND TERMINAL-PIN ASSEMBLY FOR AN ELECTRIC LAMP

CROSS-REFERENCE TO RELATED APPLICATION

The subject matter of the present application constitutes an improvement over that disclosed and claimed in concurrently-filed application Ser. No. 136,649, of V. L. Plagge et al, which application is assigned to the assignee of the present application.

BACKGROUND OF THE INVENTION

This invention generally relates to electric lamps and has particular reference to an improved base and terminal-pin assembly for a fluorescent lamp.

Conventional type fluorescent lamps as currently manufactured are provided with a base assembly at each end that has a pair of hollow brass pins which are staked to the insulator portion of the base and serve as "bi-pin" terminals for the finished lamp. During the lamp-basing operation, the lead wires which extend from the sealed ends of the envelope are threaded through apertures in the tips of the hollow base pins and then trimmed and electrically connected to the pins by either soldering or welding after the base has been placed on the sealed end of the envelope. Due to the small size of the base pins and the random location of the lead wires relative to the sealed ends of the lamp envelope, it is very difficult to align the lead wires with the pins and then thread them through the pin apertures during the basing operation, particularly at the high-production speeds used in the industry. The lead-wire soldering or welding operation also creates manufacturing problems since they both require equipment that is not only costly to maintain but, unless properly adjusted and constantly monitored, frequently produces poor welds or soldered connections with resultant high "shrinkage" rates and losses in both material and labor. Dirt in the pins, insufficient solder flux and dirty welding electrodes also make it very difficult to produce reliable soldered or welded connections on a consistent basis. It would accordingly be very desirable to provide a base assembly and a terminal-pin structure that would eliminate all of the foregoing manufacturing and quality-control problems.

Various proposals for mechanically connecting the lead wires of an electric lamp to a base component have been employed in the prior art. For example, in U.S. Pat. No. 2,771,589 issued Nov. 20, 1956 to Thomas, the lead wires of a fluorescent lamp are mechanically anchored in "pockets" within the plastic base member by force-fitted metal eyelets to provide a recessed-contact type base assembly. In U.S. Pat. No. 3,546,523 to Gilbert, Jr., the lead wires of a circular-shaped fluorescent lamp are connected to the base pins by forcing the ends of the lead wires into the slotted inner ends of base pins that are embedded in the holder portion of a "snap" type base assembly. In U.S. Pat. No. 2,913,697 to Caplis et al, (FIGS. 1–4 embodiment), the lead wires of a "three-light" type incandescent lamp are fastened to the plastic insulator of the base assembly by nails of easily deformed material, such as lead, that are forcibly driven into the insulator and effect an electrical juncture with the clamped ends of the lead wires.

In accordance with the teachings of the aforementioned concurrently-filed application Ser. No. 136,649 of Plagge et al, the manufacturing and quality-control problems associated with the use of conventional fluorescent lamp bases having hollow metal pins that must be threaded over and then soldered or welded to the lead wires are avoided by using pins of solid metal (or tubular pins of tempered sheet-metal) that are dimensioned to effect a force fit with the lead-wire apertures of the plastic insulator portion of the base and concurrently clamp the substantially straight ends of the lead wires (which are disposed in the apertures) in positive electrical engagement with the inserted pins. According to one embodiment of the aforementioned Plagge et al application, the lead wires extend directly from the lamp stem into the insulator apertures and are precut so that the pin-clamped ends of the wires are substantially flush with the outer face of the insulator. The Plagge et al application also discloses and claims another embodiment wherein the base insulator is provided with a second pair of apertures and the lamp lead wires are arranged so that they extend through such apertures, along the outer face of the insulator and then into the pin apertures so that the clamped ends of the wires are located inside the base assembly. While both of these embodiments are satisfactory from a functional standpoint, it has been found that leaving the cut ends of the lead wires exposed at the outer face of the base insulator is rather unsightly and may constitute a potential safety hazard, particularly if the ends of the lead wires are not precisely flush with the surface of the insulator. It would also be desirable to eliminate the additional operation of inserting the lead wires through a second pair of apertures as required by the other embodiment of the Plagge et al application.

SUMMARY OF THE INVENTION

The foregoing problems and disadvantages associated with the prior art lamp bases which employ soldered or welded base pin terminals, as well as those encountered with mechanically-effected electrical connections provided by force-fitted metal pins pursuant to the aforementioned Plagge et al application, are avoided by providing a base assembly which not only employs force-fitted metal pins to effect electrical connection with the lamp lead wires but also requires lead wires which are trimmed to a length such that a predetermined segment of each of the wires protrudes beyond the end face of the plastic base insulator when the base is first seated on the sealed end of the envelope. After the base pins have been partially inserted into the insulator apertures, the protruding end segments of the respective wires are tightly wrapped or coiled around the pins which are then inserted into fully-seated and anchored position within the insulator, thus forcing the coiled end segments of the lead wires into shallow cavities provided in the outer surface of the base insulator and recessing them within the confines of the insulator. To insure that the coiled ends of the lead wires are clamped within the insulator cavities, a circumferential shoulder or bead is preferably provided on each of the metal pins at locations such that the beads automatically engage and firmly press the coiled ends of the wires into the insulator cavities during the pin-inserting operation.

BRIEF DESCRIPTION OF THE DRAWING

A better understanding of the invention will be obtained from the exemplary embodiment shown in the accompanying drawing, wherein.

DESCRIPTION OF THE PREFERRED EMBODIMENT

While the present invention can be employed in the manufacture of various types of electric lamps which require pin terminals of the kind that create the aforementioned production and quality-control problems, it is particularly adapted for use in conjunction with the manufacture of low-pressure discharge lamps such as fluorescent lamps and it has accordingly been so illustrated and will be so described.

Figure 1:
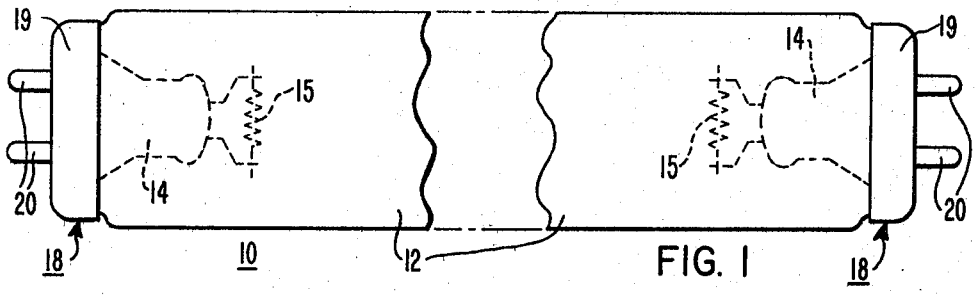
FIG. 1 is a side elevational view of a fluorescent lamp which embodies the invention, a portion of the lamp envelope being omitted for convenience of illustration.

A fluorescent lamp 10 which has the novel base and terminal-pin construction of the present invention is illustrated in FIG. 1. As will be noted, the lamp 10 consists of the usual tubular vitreous or glass envelope 12 that is provided with an inner coating of phosphor and is hermetically sealed at each end by a glass stem 14. In accordance with standard lamp-making practice, the envelope 12 is filled with a suitable starting gas (such as several Torr of neon or the like) and also dosed with mercury to provide an ionizable medium within the sealed envelope which permits an electric discharge to pass between a pair of thermionic electrodes 15 mounted on the respective stems 14. Each of the sealed ends of the envelope 12 are fitted with a base assembly 18 that includes a pair of axially-extending metal pins 20 which serve as terminals for the lamp 10 and are adapted, by virtue of their spacing and dimensions, to permit the lamp to be inserted into the socket components of a lighting fixture and be operated from a suitable electrical power supply.

Figure 2:
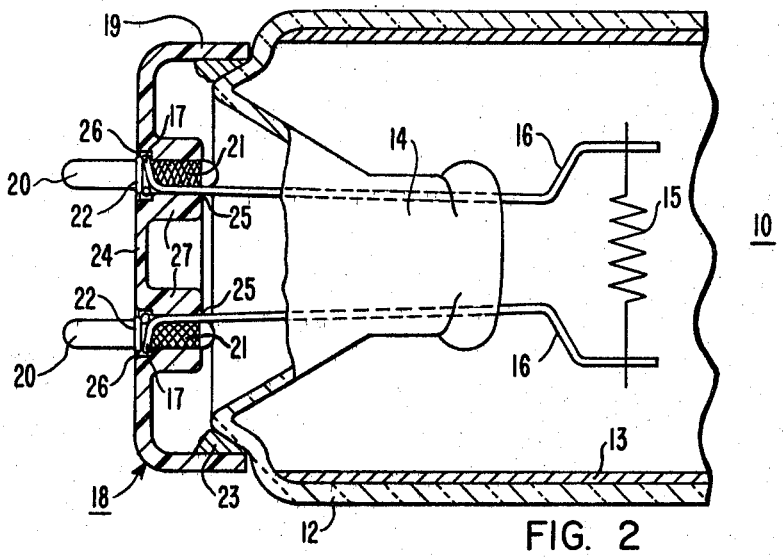
FIG. 2 is an enlarged sectional view of one end of the lamp shown in FIG. 1 illustrating the structural features of the improved base and pin terminals in greater detail.

As shown more particularly in the enlarged sectional view of one end of the fluorescent lamp 10 illustrated in FIG. 2, the phosphor coating 13 extends to the seal area (formed by fusing the glass stem 14 to the end of the tubular envelope 12) and the electrodes 15 are fastened to a pair of conductors such as lead-in wires 16 that extend from the associated stem into the base assembly 18.

Each of the base assemblies 18 comprise a cap-shaped member or shell 19 of suitable insulating material such as a thermosetting plastic (a wood-filled phenolformaldehyde plastic resin, for example) that has an end wall 24 which supports the terminal-pins 20. The base shell 19 is secured to the sealed end of the envelope 12 by a ring of cement 23 or other suitable means.

In accordance with the invention, the terminal members of the fluorescent lamp 10 comprise a pair of metal pins 20 having end segments 21 that are dimensioned to effect a tight frictional force-fit with a pair of apertures 25 that are provided in the insulator portion or end wall 24 of the base shell 19. The required electrical juncture with the lead wires 16 is achieved by inserting the precut ends of the wires through the base apertures 25, before the pins 20 are inserted, so that the wires are firmly clamped in positive electrical contact with the end segments 21 of the pins when the latter are forcibly inserted into the apertures and are seated therein. The lead wires 16 are of such length that their end portions initially extend beyond the base apertures 25 and are subsequently tightly wrapped around a medial part of the associated pins 20, thus forming loops or coils 17 of one turn (or part of a turn) that are pressed into and recessed within shallow cavities 26 which are provided in the outer face of the base end wall 24. To insure that the coiled end segments 17 of the lead wires 16 are pushed into completely-recessed position within the cavities 26 when the pins 20 are forcibly inserted into the base apertures 25, each of the pins 20 are provided with a laterally-protruding portion such as a bead-like shoulder 22 that extends around the periphery or circumference of the pin. The cavities 26 are larger in dimension than the shoulder portions 22 of the base pins 20 to insure that the coiled end segments 17 of the lead wires 16 are firmly pressed into the respective cavities during pin insertion and are thus entrapped between the base end wall 24 and shouldered parts of the pins.

As a specific example, satisfactory terminals have been produced in experimental 40 watt fluorescent lamps using copper-clad lead-in wires 0.5 mm. in diameter and bases having insulator apertures 2.8 mm. in diameter with circular counter bores or surface cavities 3.6 mm. in diameter and 1.0 mm. deep. The base pins were 2.37 mm. in diameter.

To prevent the end wall 24 of the plastic base shell 19 from cracking during the pin-inserting operation, the parts of the shell which define the apertures 25 are reinforced by bosses 27 that extend inwardly from the end wall 24. The bosses 27 increase the wall thickness of the wall at these locations by an amount sufficient to enable the plastic end wall 24 to withstand the stresses produced by the force-fitting of the terminal pins 20.

Figure 3:
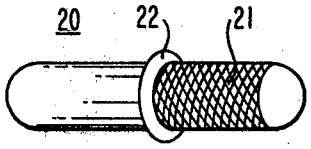
FIG. 3 is an enlarged pictorial view of one of the base pins employed in the fluorescent lamp shown in FIGS. 1 and 2.

As shown more particularly in FIG. 3, the terminal pins 20 are preferably circular in cross-section and may be fabricated from solid metal such as brass or aluminum. If aluminum is employed, it can be plated with a suitable metal (such as copper or the like) to provide protection against corrosion, if necessary. The pins 20 can be formed from wire stock which is cut into the required lengths by a suitable automated unit that will also perform the pin-insertion operation during lamp manufacture. The pins can also be made in the form of hollow metal tubes from sheet metal that has been stiffened by heat-tempering (either during or after pin manufacture) to make the tubular pins rigid and strong enough to withstand the force-fitting operation.

In order to enhance the mechanical interlock between the force-fitted pins 20 and the plastic insulator or end wall 24 and prevent the inserted pins from possibly becoming loose, the ends 21 of the pins are provided with a "rough" surface. This can be formed by scoring the ends of the pins to provide a knurled finish (such as that shown) having sharp ridges or protrusions that "bite" into the plastic material and thus increase the penetration and frictional gripping action between the pins and plastic insulator part of the base. As will be noted, the outer ends of the pins 20 which constitute the terminals for the finished lamp 10 are rounded and have a smooth finish.

Figure 4:
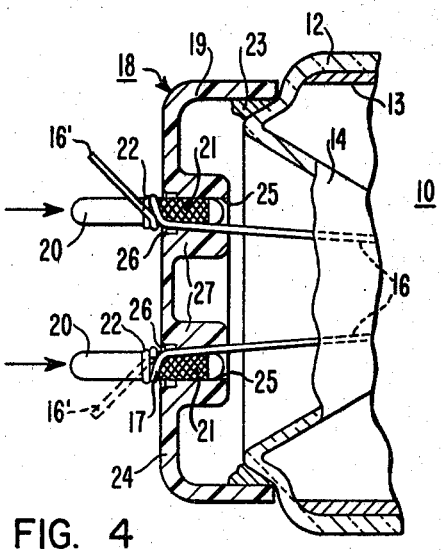
FIG. 4 is another enlarged sectional view of one end of the fluorescent lamp shown in FIG. 1 illustrating the manner in which the protruding ends of the lead wires are trimmed and then wrapped around the respective base pins before the latter are fully inserted into the base insulator.

As shown in FIG. 4, the lead wires 16 are trimmed to a predetermined length so that the end segments 16' which protrude beyond the base apertures 25 (after the base shell 19 has been placed in seated position on the sealed end of the envelope 12) are just long enough to form no more than one turn when the protruding ends of the wire are tightly wrapped around the respective pins 20. The pins 20 are depicted in FIG. 4 in partially inserted position and the pin shown in the upper portion of this Figure has not yet had the associated end 16' of the lead wire wrapped around it. The pin located at the lower portion of the base 18, as viewed in FIG. 4, has its lead wire end 16' (shown in phantom) wrapped around its medial portion and coiled into a loop 17 of one turn which is engaged by the laterally-protruding shoulder or bead 22 of the pin. This arrangement insures that the looped or coiled end segments 17 of the respective lead wires 16 are "captured" by the pins and then firmly seated in and recessed within the shallow cavities 26 in the plastic end wall 24 of the base 18 when the pins 20 are pushed into their fully inserted positions, as indicated by the arrows.

While the base shell 19 of the illustrated base assembly 18 is of "all-plastic" construction, the invention is not limited to this specific type of base but can also be employed with "composite type" base assemblies that have a metal shell component with a plastic insulator member that is secured to the metal shell and forms the end wall of the base. The pins, in this case, would be force-fitted into suitable holes that are provided in the plastic insulator component and receive the precut ends of the lamp lead wires.

We claim as our invention:

1. In an electric lamp having a vitreous envelope with an end portion that has a protruding lead-in conductor and is secured to a base structure, the improvement comprising the combination of;

an insulator component of plastic resin material that constitutes an end wall portion of the base structure and has an aperture therein, said lead-in conductor being of such length and being so arranged that it extends into and through the aperture in the plastic insulator component and is terminated by an end portion of predetermined length that is located beyond the insulator aperture, a rigid metal pin of predetermined length having an end segment in force-fitted frictional engagement with the apertured portion of said plastic insulator component and mechanically locked thereby in positive electrical contact with the part of the lead-in conductor that is disposed in said aperture, the terminating end portion of said lead-in conductor being wrapped around a medial part of said metal pin and pressed against the outer face of the plastic insulator component by a laterally protruding portion of said pin which is located on the said medial part thereof, the free end segment of said pin extending outwardly from the base structure and plastic insulator component a distance such that the pin constitutes an exposed elongated terminal of controlled size and configuration for the electric lamp.

2. The improvement of claim 1 wherein the force-fitted end segment of the metal terminal-pin has a rough surface with protrusions that penetrate and firmly grip the plastic insulator component.

3. The improvement of claim 2 wherein said terminal-pin is composed of solid metal.

4. The improvement of claim 1 wherein;

said electric lamp comprises a discharge lamp of the low-pressure type that has a tubular glass envelope with a sealed end portion from which a pair of lead-in wires extend, said sealed end portion being secured to the base structure, the plastic insulator component of said base structure has a pair of spaced apertures therein through which the respective lead-in wires extend, and each of the insulator apertures have a force-fitted metal pin therein and said discharge lamp thus has a pair of exposed pin terminals, the terminating end portions of the respective lead-in wires being wrapped around the associated pins and entrapped between the plastic insulator component and laterally protruding portions of the pins.

5. The improvement of claim 4 wherein;

the portions of the outer face of said plastic insulator component which surround the pair of spaced apertures are contoured to define shallow surface cavities thereat and, the end portions of the respective lead-in wires that are wrapped around the metal pins are substantially recessed within the respective surface cavities in the outer face of the insulator component.

6. The improvement of claim 5 wherein;

said electric discharge lamp comprises a fluorescent lamp which has a tubular envelope that is sealed at each end to a glass stem from which a pair of lead-in wires extend, each of the sealed ends of the envelope is secured to a base structure having a plastic component with exposed terminal pins that are in force-fitted engagement with the respective lead-in wires, each of said base structures is of cap-like configuration and is secured in encircling relationship with the sealed ends of the tubular envelope, and said terminal-pins are composed of solid metal or heat-tempered sheet metal in rigid tubular form and extend in an axial direction outwardly from the respective plastic components of said cap-like base structures so that each end of the fluorescent lamp has a pair of spaced exposed terminals.

7. The improvement of claim 6 wherein the laterally protruding portions of said metal pins each comprise a bead-like shoulder that extends around at least part of the periphery of the respective pins.

8. The improvement of claim 6 wherein the apertured portions of each of said plastic insulator components have thickened wall dimensions which provide reinforcing bosses on the inner surfaces of the respective insulator components.

9. The improvement of claim 6 wherein the force-fitted end segments of the metal pins have rough surfaces with a plurality of protrusions that cut into and firmly grip the plastic insulator components.

10. The improvement of claim 6 wherein the metal pins are of substantially circular cross-section and the length of each of the terminating end portions of the lead-in wires relative to the pin diameter is such that the wrapped-around end portions of the lead-in wires each form a coil of no more than a single turn that is recessed within the associated surface cavity of the plastic insulator component.

* * * * *